United States Patent [19]

Sedlmair

[11] Patent Number: 4,763,918

[45] Date of Patent: Aug. 16, 1988

[54] SKI BRAKE

[75] Inventor: Gerhard Sedlmair, Farchant, Fed. Rep. of Germany

[73] Assignee: Marker Deutschland GmbH, Fed. Rep. of Germany

[21] Appl. No.: 67,693

[22] Filed: Jun. 29, 1987

[30] Foreign Application Priority Data

Jun. 30, 1986 [DE] Fed. Rep. of Germany ..... 3621944

[51] Int. Cl.[4] ..... A63C 5/00

[52] U.S. Cl. ..... 280/605

[58] Field of Search ..... 280/604, 605, 809

[56] References Cited

U.S. PATENT DOCUMENTS

| | | | |
|---|---|---|---|
| 4,231,584 | 11/1980 | Kikuchi | 280/604 |
| 4,268,060 | 5/1981 | Svoboda | 280/605 |
| 4,386,789 | 6/1983 | Horn | 280/605 |
| 4,676,520 | 1/1987 | Gasguet et al. | 280/605 |

FOREIGN PATENT DOCUMENTS

| | | |
|---|---|---|
| 2635155 | 5/1984 | Fed. Rep. of Germany . |
| 11473 | 10/1980 | Japan . |

*Primary Examiner*—John J. Love
*Assistant Examiner*—Richard Camby
*Attorney, Agent, or Firm*—D. Peter Hochberg; Mark M. Kusner; Walter C. Danison, Jr.

[57] ABSTRACT

The invention relates to a ski brake that is integrated into the housing of a safety ski binding. The ski brake has a pair of bushings aligned along a horizontal axis through the housing of the ski binding. The bushings rotate in the housing of the binding and have non-circular axially aligned openings that move the arms of the ski brake outwardly, around the ski, as the arms are deployed. The short lever arm sections of the L-shaped ski brake arms are spring biased into contact with the bushing surfaces and are moved according to the non-circular surfaces in the bushing.

9 Claims, 5 Drawing Sheets

SKI BRAKE

BACKGROUND OF THE INVENTION

The present invention relates to a ski brake, and more particularly to a ski brake which is integrated within the housing of a safety ski binding.

PRIOR ART

Japanese Patent Publication No. 56-11473 dated Mar. 14, 1981, discloses a ski brake wherein the pivotal movement of the brake wings about a transverse pivot is controlled by the longitudinal movement of the housing relative to a guide rail which is fixed to the ski. The free ends of the brake wings are normally retracted toward the center of the ski. In this respect, the brake wings extend in length beyond their axis which is normal to the transverse pivot, and by means of these extensions cooperate with control cams provided on the side walls of the housings. These extensions are resiliently urged against the cams. As the housing is moved toward the rear or tail of the ski, the brake wings turn about the transverse pivot wherein the free ends of the extensions of the brake wings run up on protruding portions of the control cams such that they are retracted toward the center of the ski.

The ski brake disclosed in the Japanese Publication has various disadvantages, which are believed to explain why it has not yet been adopted in practice. For instance, the mechanism for retracting the brake wings is disposed outside the housing and mars the appearance of the ski binding. Moreover, the mechanism may be deranged and can easily be damaged by external influences. Still further, the design involves a large overall width of the housing.

SUMMARY OF THE INVENTION

It is an object of the present invention to provide a ski brake which is integrated in a housing of a safety ski binding and which permits the use of a housing that has a normal overall width.

It is another object of the present invention to provide a ski brake as defined above wherein the brake is compact and composed of parts which can easily be manufactured.

A still further object of the present invention is to provide a ski brake as defined above, which brake is less susceptible to manfunction.

In accordance with the present invention there is provided a ski brake integrated in the housing of a safety ski binding for impeding the movement of a ski down a slope when the ski is detached from a skier's boot. The ski brake comprises a pair of bushings aligned along a horizontal axis through a housing of a ski binding. Each of the bushings is rotatable in the housing about the axis and includes an axially aligned opening of predetermined configuration. Ski boot engaging means connected to the bushings are provided for rotation therewith between a first position wherein a ski boot is in the binding and a second position wherein the boot is removed from the binding. Means for biasing the ski boot engaging means toward the second position are provided together with a pair of brake members. Each brake member includes a braking arm with a free end and a lever arm with a free end. The lever arm is disposed within the opening in a bushing with its free end mounted for movement pivotally about an axis rotatable with the bushing. The lever arm is in operative engagement with the opening in the bushings to move the free ends of the braking arms from a retracted position above and toward the center of the ski to a braking position below and outward of the ski when the bushing rotates in response to movement of the ski boot engaging means from the first position to the second position.

BRIEF DESCRIPTION OF THE DRAWINGS

An illustrative embodiment of the present invention will now be described in detail with reference to the accompanying drawings, in which.

DETAILED DESCRIPTION OF PREFERRED EMBODIMENT

Figure 1:
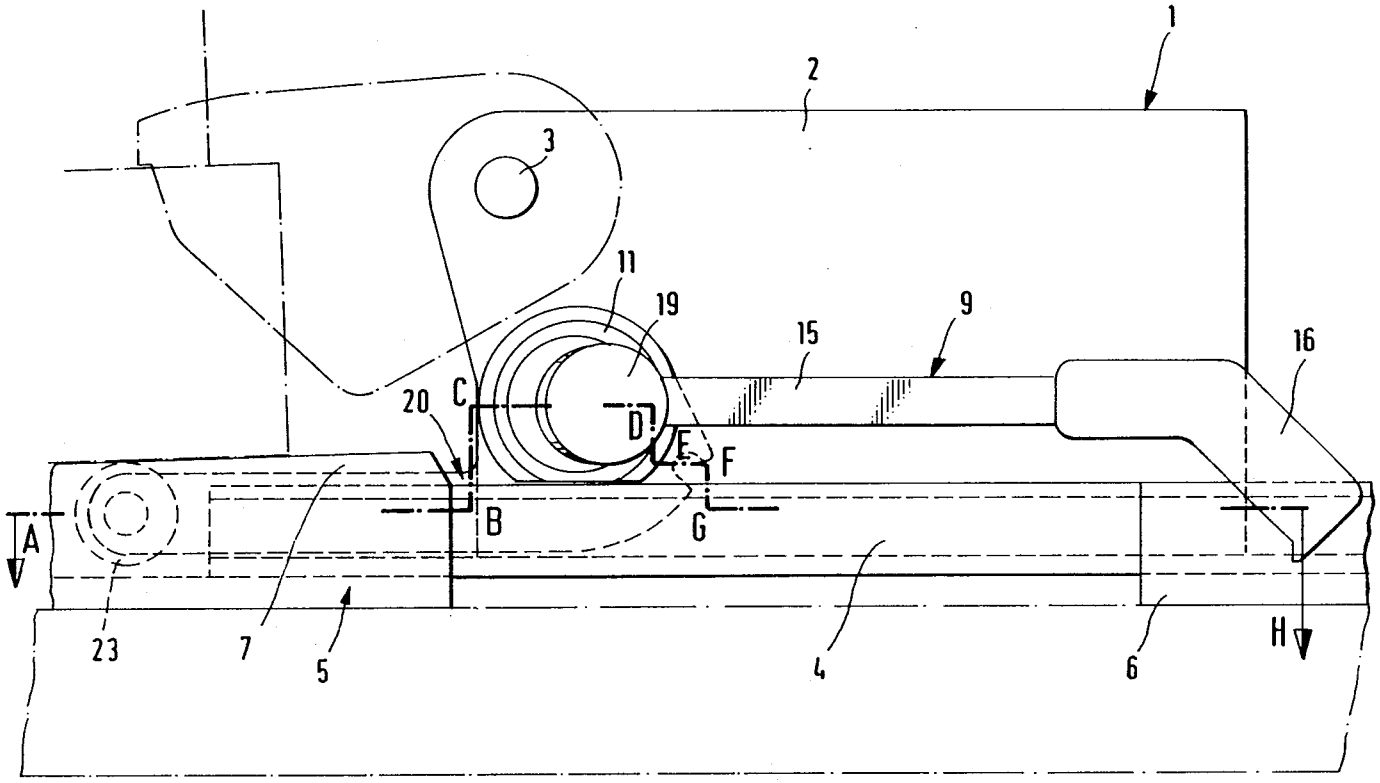
FIG. 1 is a side elevational view showing the heelholding section of a safety ski binding having an integrated ski brake according to the present invention in a state in which the ski is ready for skiing.

Referring now to the drawings wherein the showing is for the purpose of illustrating a preferred embodiment and not for the purpose of limiting same, FIG. 1 shows a ski binding comprised of a heelholding section. Inasmuch as the specific design of the heelholding section is not essential for the present invention, the heelholding section has been shown only to the extent which is required for an understanding of the invention. The soleholder portion of the binding is indicated in phantom in FIGS. 1 and 3, which also shows in phantom the rear end of a skiing boot. The heelholding section comprises a housing 2, to which the soleholder is mounted on a horizontal transverse pivot 3 to be pivotally movable in the usual manner against the force of a spring and/or arbitrarily. The ski brake in accordance with the invention is movably mounted in the housing and will be described in detail hereinafter.

Figure 2:
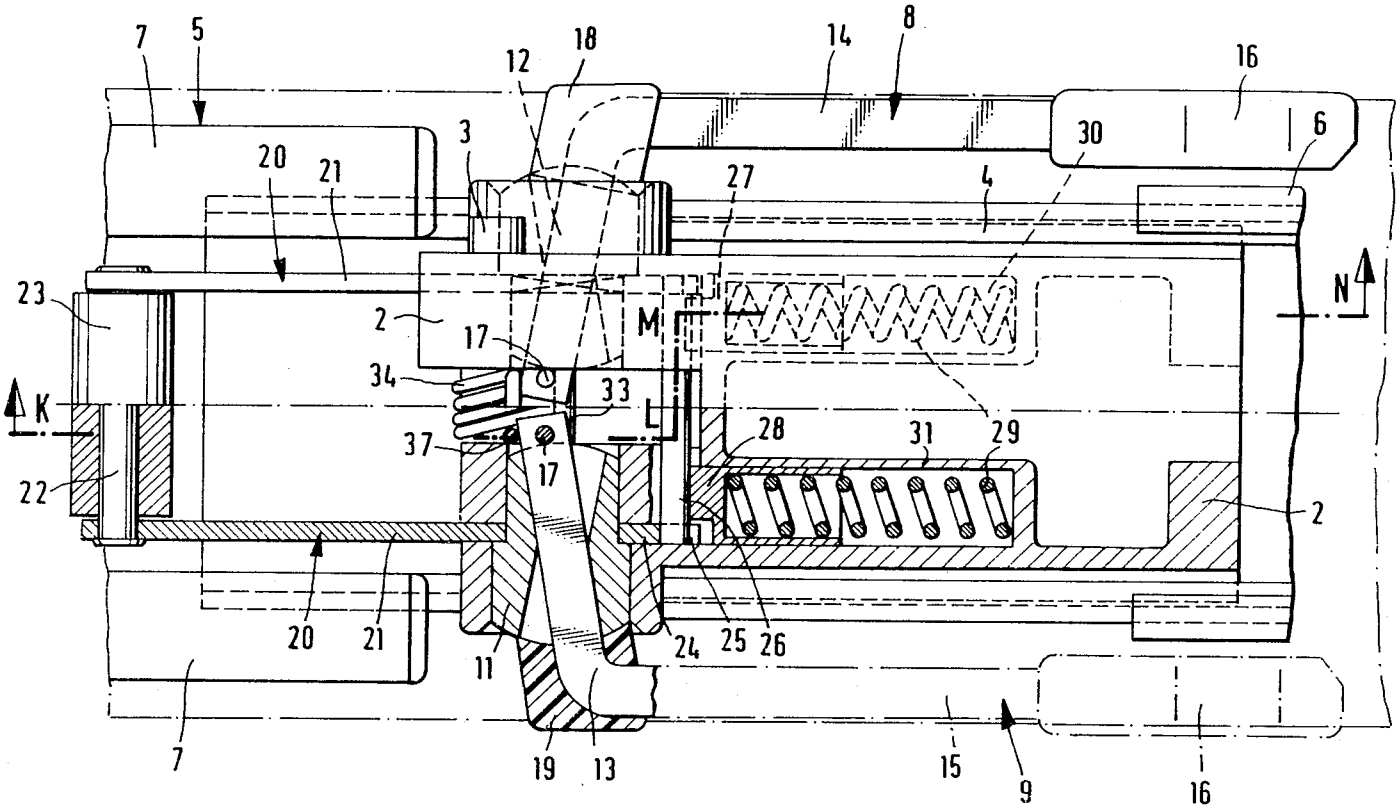
FIG. 2 is in its upper half a top plan view of FIG. 1 and in its lower half a sectional view taken on line A to H in FIG. 1.

Housing 2 includes a carriage, which is longitudinally, slidably mounted in the usual manner on a baseplate 4. Baseplate 4 is fixedly connected to a tread plate 5, by which the baseplate is adapted to be fixed to a ski which is indicated in phantom. A U-shaped retaining member 6 is adapted to be mounted on the ski and constitutes a bearing for guiding the rear end of baseplate 4 as it is displaced. Tread plate 5 is provided with two ribs 7, which are symmetrical to a vertical longitudinal plane and serve to support the rear end of the skiing boot (see particularly FIG. 2).

The ski brake includes two brake wings 8, 9, which are mirror images of each other and each of which is comprised of an L-shaped wire piece. In accordance with the present invention the horizontal transverse pivot of the ski brake is comprised of two coaxial bushings 10, 11, each of which receives the short arm 12 or 13 of an associated brake wing. Each brake wing is comprised of a non-circular wire piece. In the present case the cross-section of the brake wings is square. The long arm or braking arm 14 or 15 of each brake wing is provided at its free end with a molded covering 16, which at its free end is angled and terminates in a sharp edge in order to ensure an effective braking. The short arms 12, 13 constitute control levers for moving the free ends of the brake wings transversely to the longitudinal direction of the ski. The bushings 10, 11 are rotably mounted in the carriage 2 and have openings which in their central portion conform to the cross-section of the short arms 12, 13. In the position shown in FIG. 2 the opening flares toward both ends of the bushing in a configuration which is at least approximately symmetrical to the pivotal axis so that the short arms can perform a corresponding pivotal movement about the axis which is vertical in FIG. 2.

An axial displacement of the short arms 12, 13 in the bushing 10, 11 is prevented in an outward direction by respective pins 17 and in an inward direction by a molded covering 18 or 19 provided on the bend of the L-shaped brake wing. The end faces of the bushings 10, 11 are curved in accordance with the radius of the pivoted arms 12, 13. Each bushing is provided in its middle region with a short reduced portion, which is non-circular. A sheet metal stamping 20 is mounted on said non-circular reduced portion of each bushing, which stamping has a hole fitting said portion. Each sheet metal stamping 20 includes two congruent two-armed levers, each lever having a first longer arm 21 and a second shorter arm 24. Longer arms 21 extend out of the carriage 2 toward the skiing boot and are interconnected at their free ends by a pin 22. Pin 22 carries a roller 23, which is intended to cooperate with the rear end of the sole of the skiing boot in a manner which will be described hereinafter. The shorter second arms 24 of the sheet meal stampings 20 extend into the carriage 2 and include radial incisions 25 for receiving pin 26 axially parallel to the surface of the ski. Pin 26 is engaged by two pressure-applying members 27, 28, which are biased by respective helical compression springs 29, which bear on the carriage 2. The pressure-applying members 27, 28 are comprised of pistons, which are movably mounted in carriage 2 in guide cylinders 30, which extend in the longitudinal direction of the ski.

Figure 3:
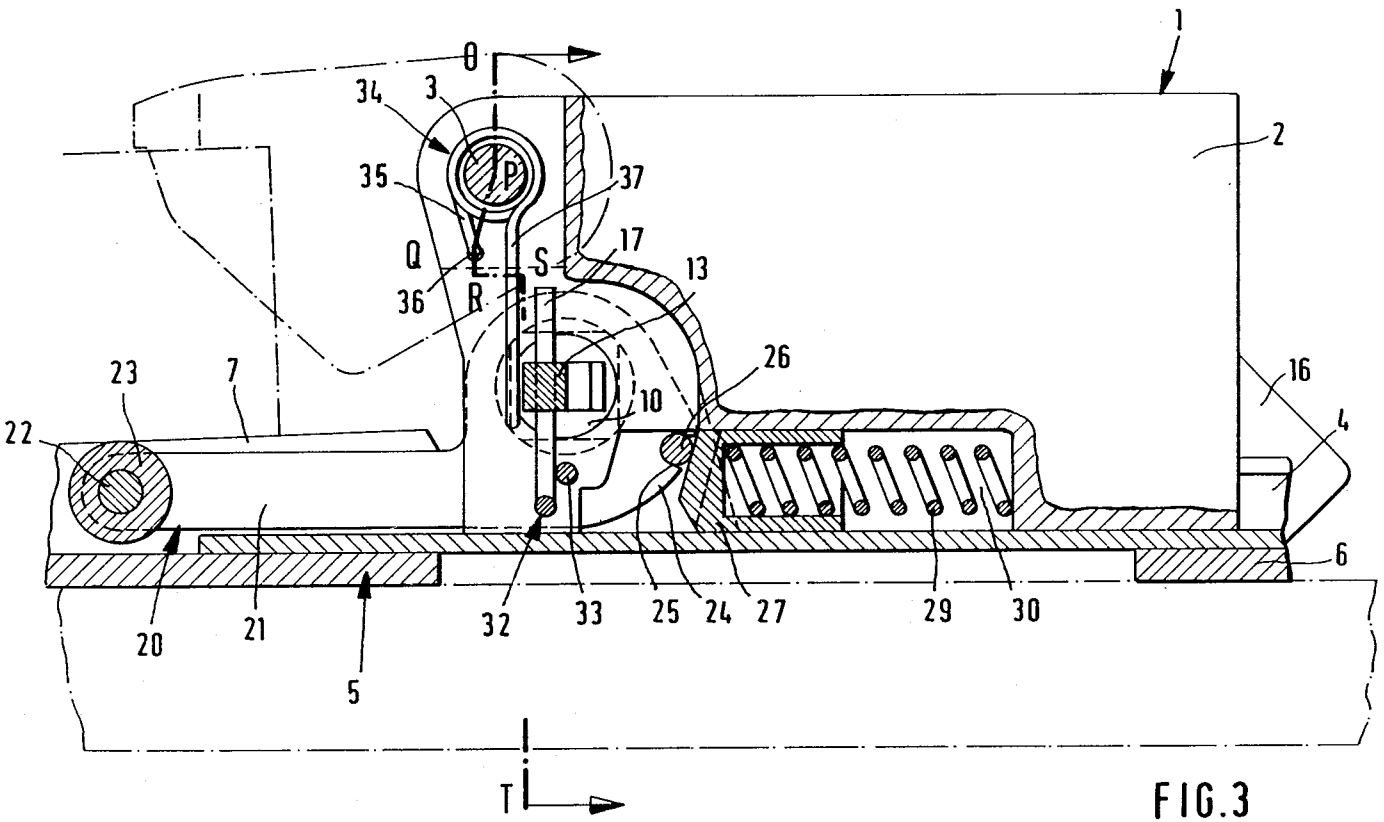
FIG. 3 is a vertical longitudinal sectional view taken on line K to N in FIG. 2.
Figure 4:
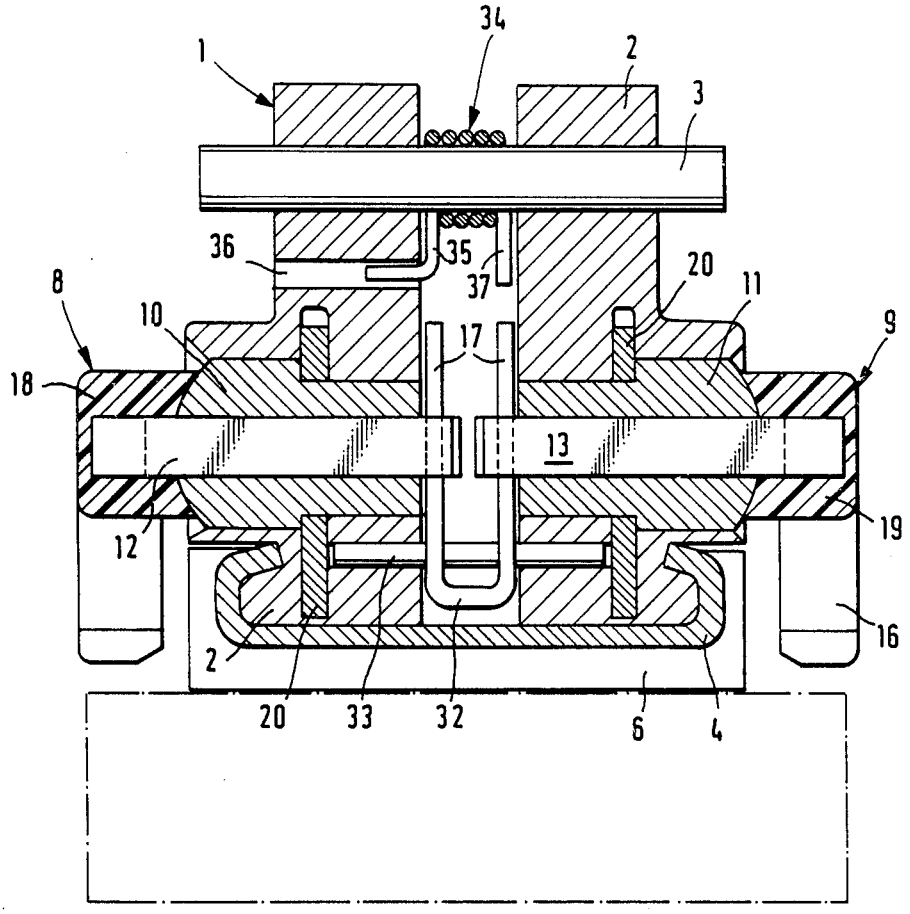
FIG. 4 is a vertical transverse sectional view taken on line O to T in FIG. 3; and, FIG. 5 is a sectional view that is similar to FIG. 3 but shows the ski brake in braking position.

Pins 17 for locking the short arms 12, 13 of the brake wings 8, 9 against axial displacement are comprised of a wire piece 32, which is bent in U-shape (see particularly FIG. 4). When the ski brake is in position of rest, that wire piece engages a stop, which is provided in the carriage 2 and is comprised of a cross-pin 33. A coiled bending spring 34 is movably mounted on the horizontal transverse pivot 3 and serves to expand the brake wings 8, 9 for effecting the shift from the position of rest to the braking position. The free end of the leg 35 of the spring is angled and is disposed in a horizontal transverse bore 36 in a wall of the carriage (see particularly FIGS. 3 and 4). The leg 37 of the spring 34 extends downwardly and is laternally and reversely bent in U-shape at its free end so that said resiliently biases the short arms 12, 13 of the brake wings 8, 9 at their free ends, which protrude from the bushings 10, 11.

FIGS. 1 to 4 show the ski brake in position of rest, in which the free ends of the long arms 14, 15 of the brake wings 8, 9 have been retracted toward the center of the ski. The ski brake will not assume that position unless the binding contains a skiing boot, as is indicated in FIGS. 1 and 3. Under the bias of the helical compression springs 29 the roller 23 bears on the underside of the sole of the skiing boot.

Figure 5:
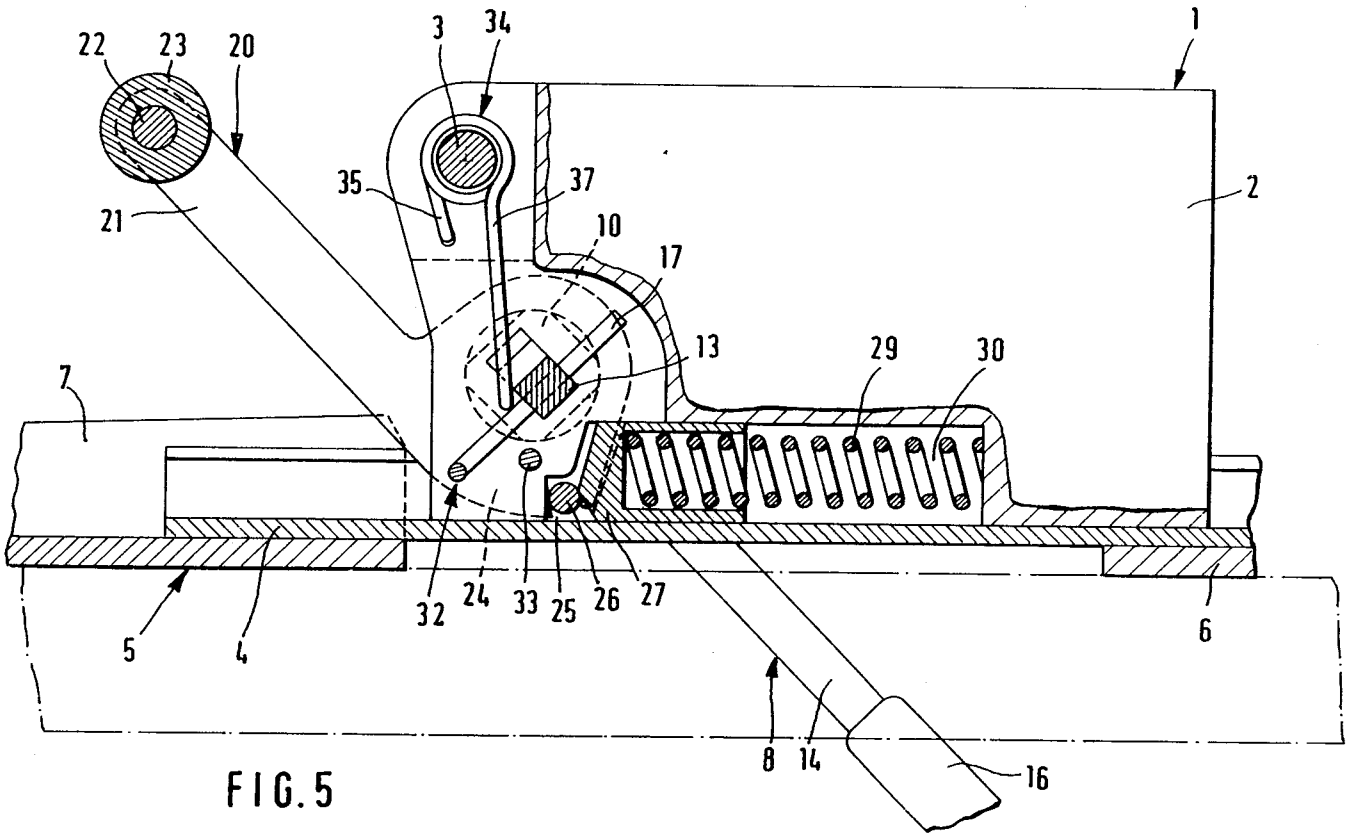

When the skiing boot is spontaneously or arbitrarily released from the ski binding and from the ski, the ski brake will swing from its position of rest to its braking position shown in FIG. 5. This is effected under the influence of the springs 29, which act on the short arms 24 of the sheet metal stampings 20 by means of the pressure-applying members 27, 28 and the pin 26 and which turn the short arms 24 of the sheet metal stampings 20 in the clockwise sense in FIGS. 1 and 3. Because the sheet metal stampings are non-rotatably connected to the bushings 10, 11, the pivotal movement is transmitted to the bushings 10, 11 and further to the brake wings 8, 9. The brake wings being to expand as the pivotal movement begins because the free ends with which the short arms 12, 13 of the brake wings protrude from the bushings 10, 11 are biased by the leg 37 of the spring 34 so that the short arms in the outwardly flaring openings of the busings are pivotally moved about an axis which is normal to the axis of the bushings.

To retract the brake wings 8, 9 against the force of the spring 34, the short arms 12, 13 are turned back in the openings of the bushings 10, 11 when the U-shaped wire piece 32 strikes against the cross-pin 33. As the pivotal movement of the brake wings in a counterclockwise sense in FIG. 5 is continued, the free ends of short arms 12, 13 are held back at their free ends, which protrude from the bushings As a result, the position of rest is finally resumed (see particularly FIGS. 2 and 3).

The invention has been described with reference to a preferred embodiment. Modifications and alterations will occur to those skilled in the art on reading and understanding this specification. It is intended that all such modifications and alterations insofar as they come within the scope of the appended claims or the equivalents thereof.

Having thus described the invention, it is claimed:

1. A ski brake integrated in the housing of a safety ski binding for impeding the movement of a ski down a slope when the ski is detached from a skier's boot, said ski brake comprising:

a pair of bushings aligned along a horizontal axis through a housing of a ski binding, each of said bushings being rotatable in said housing about said axis and including an axially aligned opening of predetermined configuration defining a noncylindrical guide surface;

ski boot engaging means connected to said bushings for rotation therewith between a first position wherein a ski boot is in said binding and second position wherein said boot is removed from said binding;

means for biasing said ski boot engaging means toward said second position;

a pair of brake members, each having a braking arm with a free end and a lever arm with a free end, said lever arm disposed within said opening in said bushing with its free end mounted for pivotal movement about an axis rotatable with said bushing, said lever arms in operative engagement with said guide surfaces of said openings in said bushings; and means for biasing said brake members, said brake member biasing means being operable to move said lever arms along said guide surfaces when said bushings rotate in response to movement of said ski boot engaging means from said first position to said second position, wherein the free end of each of said braking arms moves from a retracted position above and toward the center of the ski to a braking position below and outward of said ski.

2. A ski brake according to claim 1, wherein each brake member is comprised of an L-shaped wire piece having a short arm which comprises the lever arm.

3. A ski brake according to claim 2, wherein said brake members are comprised of non-circular wire pieces.

4. A ski brake according to claim 3, wherein the ends of said bushings are formed with flared openings and are curved in such a manner that the center of curvature coincides with the pivot points of the control levers and said ski brake further comprises molded elements to hold the control levers in said bushings against a longitudinal displacement.

5. A ski brake according to claim 3 wherein said bushings are formed at both ends with flared openings.

6. A ski brake according to claim 1 wherein said ski boot engaging means is comprised of a lever arrangement which are non-rotatably connected to said bushings.

7. A ski brake according to claim 6 wherein said spring means engages said lever arrangement through the intermediary of a pressure-applying member and of a pin mounted on said lever arrangement.

8. A ski brake as defined in claim 7 wherein said lever arrangement includes two arm portions wherein the second arm portion comprises a pedal for cooperation with the sole of the skiing boot.

9. A ski brake according to claim 8 wherein the free end of the second arm portion includes a pin and a roller which is movably mounted thereon.

* * * * *